United States Patent [19]

Bachmann et al.

[11] Patent Number: 4,577,854

[45] Date of Patent: Mar. 25, 1986

[54] METHOD AND APPARATUS FOR THE POSITIONING OF TEXTILE SURFACE CONFIGURATIONS

[75] Inventors: Bernd Bachmann, Altenburg; Peter Kuss, Dittsmannsdorf; Frank Schuhmann, Altenburg; Jürgen Wöllner, Nobitz, all of German Democratic Rep.

[73] Assignee: VEB Kombinat Textima, Karl-Marx-Stadt, German Democratic Rep.

[21] Appl. No.: 467,058

[22] Filed: Feb. 16, 1983

[30] Foreign Application Priority Data

Mar. 22, 1982 [DD] German Democratic Rep. ... 238342

[51] Int. Cl.[4] ..... B65H 7/02

[52] U.S. Cl. ..... 271/227; 271/236; 271/239; 271/241

[58] Field of Search ..... 271/227, 234, 236, 239, 271/248, 249, 250, 228, 241, 247, 252; 269/25, 55, 56, 91

[56] References Cited

U.S. PATENT DOCUMENTS

| | | | |
|---|---|---|---|
| 3,378,257 | 4/1968 | Boynton et al. | 271/227 |
| 4,102,374 | 7/1978 | Klein | 269/25 |
| 4,142,661 | 3/1979 | Nettles et al. | 271/250 |
| 4,210,077 | 7/1980 | Lindstrom | 271/241 |
| 4,448,407 | 5/1984 | Bashford et al. | 271/228 |

*Primary Examiner*—Bruce H. Stoner, Jr.
*Assistant Examiner*—John A. Carroll
*Attorney, Agent, or Firm*—Jordan and Hamburg

[57] ABSTRACT

The solution according to the invention serves to position textile surface configurations, especially cut parts for pieces of clothing. It is the object of the invention to create an apparatus, with which sewing material parts can be positioned in two coordinates in a simple manner. In the invention, the sewing material is moved against a contact edge of a positioning table in the x-direction by air nozzles, which are alternately guided by sensors. The sewing material edge is clamped by a vertically-adjustable clamping device. The positioning table is then moved in the y-direction until the sewing material edge reaches a sensor.

6 Claims, 3 Drawing Figures

METHOD AND APPARATUS FOR THE POSITIONING OF TEXTILE SURFACE CONFIGURATIONS

BACKGROUND OF THE INVENTION AND PRIOR ART STATEMENT:

The invention relates to a method and an apparatus for the positioning of textile surface configurations, especially of cut pieces for clothing.

Apparatuses are previously known in which the alignment of textile surface configurations is accomplished by directional air flows and a supporting air cushion. These apparatuses as described for example in DE-OS No. 1 611 379 and DE-OS No. 2 523 986 U.S. Pat. No. 3,918,706), have the disadvantage that the sewing material is inaccessibly located between two plates and cannot be removed from the positioning apparatus following alignment, and cannot be deposited in the positioning apparatus when grasped by a suitable separation device.

An apparatus described in DE-OS No. 2 717 960 (U.S. Pat. No. 4,176,832) does not have this disadvantage, however, the suggested solution is relatively complicated and only allows positioning in one coordinate and is thus unsuited for the congruent positioning of two or more cut pieces on top of one another. In order to accomplish a perfect alignment of the sewing material, it is necessary that the cut pieces, especially the material edges scanned by sensors, are evenly positioned on the base. However, this cannot always be assured in practice.

It is the object of the invention to create an apparatus with which pieces to be sewn can be positioned in two coordinates in a simple manner. The detrimental influence of conveying- and cutting-dependent defects of the sewing material (folds, bent edges, or the kind)is to be virtually eliminated.

SUMMARY OF THE INVENTION

It is the object of the invention to create an apparatus which allows the positioning of cuts from textile surface configurations in two coordinates with the least possible effort. The positioning result is to be relatively independent of the evenness of the cuts.

The object is accomplished by the invention in that the sewing material is placed on a positioning table having a horizontal inclination angle of $\alpha$, and slides against an edge contact point. The sliding ability can be further improved by an air cushion operating perpendicular to the surface of the positioning table.

Two photoelectric sensors are immediately located at the contact edge and are placed at a distance from one another which is smaller than the length of the edge of the sewing material to be scanned. Two nozzles are placed in the positioning table across from these sensors, produce an air flow which is directed towards the edge contact point and parallel to the surface of the positioning table, and can be independently switched on. A sensor controls the nozzle located across from the other sensor, resulting in a shimmying of the sewing material at the contact edge.

After the positioning in the x-direction has been perceived by the sensors, the edge of the sewing material adjacent to the contact edge is pulled smooth and clamped into a clamping device, which can be adjusted by a pneumatic operating cylinder or electromagnet, perpendicular to the surface of the positioning table.

The entire positioning table then moves rapidly in the y-direction until a sensor perceives the edge of the sewing material. The rapid forward movement is changed to a slow pace and is stopped as soon as an additional sensor is reached. In order to simplify the apparatus, the additional sensor can be omitted, eliminating the slow pace phase.

After the positioned sewing material has been removed from the positioning table, the table returns to its original position.

The positioning table is preferably actuated by a spindle drive with electromotor. Photoelectric initiators are used as sensors.

BRIEF DESCRIPTION OF THE DRAWINGS

The invention will be explained by means of the following example.

In the corresponding drawings.

DETAILED DESCRIPTION OF A PREFERRED EMBODIMENT

Figure 1:
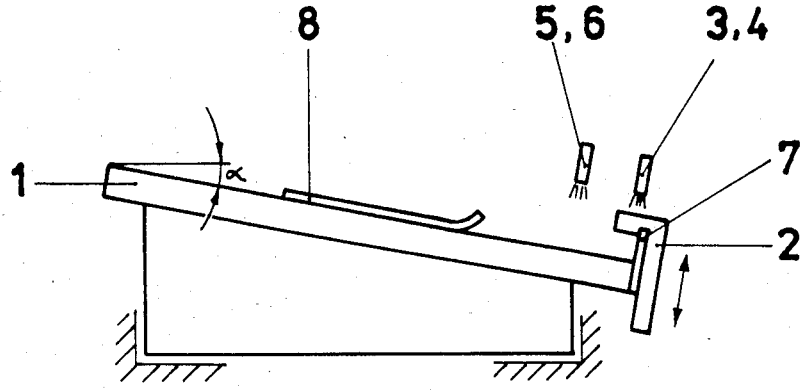
FIG. 1 illustrates the apparatus at the time of depositing the sewing material (side view)
Figure 2:
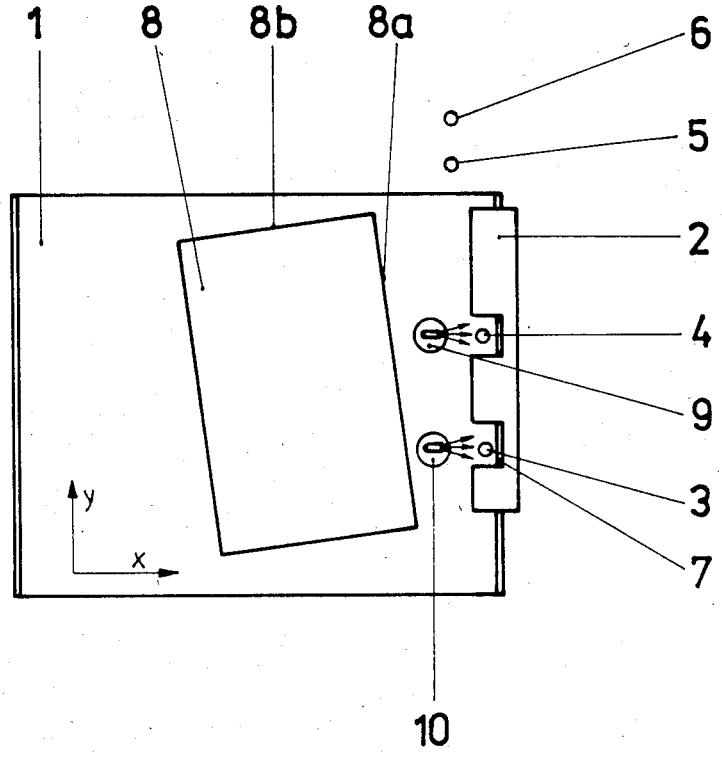
FIG. 2 illustrates the apparatus at the time of depositing the sewing material (top view)
Figure 3:
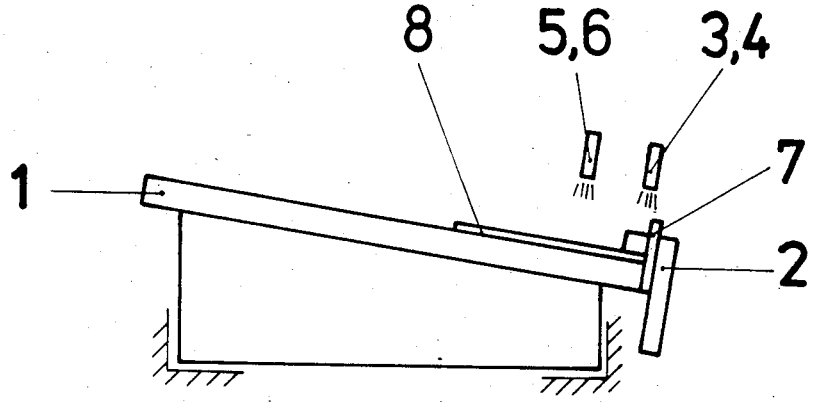
FIG. 3 illustrates the apparatus after the sewing material has been positioned in the x-direction.

The positioning table 1 is adjustably positioned in the y-direction. It is inclined at an angle of $\alpha$ perpendicular to the direction of motion.

A hollow chamber is located inside the positioning table with a compressed air connection. The surface of the table has air exit openings, which exit in the hollow chamber. During the positioning process, a supporting air cushion can thus be produced, improving the sliding ability.

A contact edge 7 is located on the side of positioning table 1. Photoelectric sensors 3 and 4 are arranged immediately at the contact edge. Air nozzles 9 and 10 enter the positioning table across from sensors 3 and 4, producing an air flow which is parallel to the surface of the table and directed towards contact edge 7.

Air nozzle 9 is switched on by sensor 3 and air nozzle 10 by sensor 4. An adjustable clamping device 2 is located in the area of contact edge 7, the clamping device being adjustable by means of a pneumatic operating cylinder perpendicular to the surface of the table.

Sensors 5 and 6 are rigidly arranged in the direction of motion behind the positioning table. If the sewing material 8 is deposited on positioning table 1, it slides against the contact edge 7 supported by the carrying air cushion and is aligned by nozzles 9 and 10 until the sewing material is completely adjacent to contact edge 7. Clamping device 2 is then moved downwardly towards the table surface and the sewing material edge 8*a* which is smoothed and clamped. The air cushion and the nozzles 9 and 10 are switched off and the positioning table moved in the y-direction by a suitable drive. When sewing material edge 8*b* passes sensor 5, the forward movement is changed from rapid to slow and stopped when reaching sensor 6. The clamping device 2 is moved upwardly, freeing the sewing material edge.

After the positioned sewing material has been removed from the positioning table, the table returns to its original position.

We claim:

1. An apparatus for positioning thin materials in two directions, comprising:

a positioning table having a contact edge along one side thereof, at least two air nozzles situated in the positioning table equidistantly away from the contact edge, said air nozzles being oriented toward the contact edge so that air is blown toward the contact edge, at least two first sensors situated adjacent to the contact edge and operationally connected to the air nozzles so that when one of the first sensors senses that the material is situated adjacent the contact edge, that sensor operates to actuate the nozzle located more remote from that sensor to cause air to flow therethrough to align the material along the contact edge, a clamping device situated along the contact edge of the positioning table so that when the material is located in a proper position, the clamping device is operated to fixedly hold the material on the positioning table, means for moving the positioning table parallel to the contact edge for a predetermined distance, and at least one second sensor situated away from the positioning table in the direction of movement thereof, said second sensor sensing the position of the material on the positioning table to stop the positioning table after it has moved the predetermined distance.

2. An apparatus according to claim 1, in which said positioning table is inclined relative to the horizontal so that the contact edge is located lower than the side opposite the contact edge.

3. A method for positioning thin materials in two directions comprising the steps of:

placing the material on a positioning table having a contact edge at one side thereof, moving the material on the positioning table by means of air flowing through at least two nozzles oriented in the direction toward the contact edge, air flow being controlled by means of at least two first sensors situated adjacent the contact edge so that the material is positioned parallel to and adjacent the contact edge, holding the material on the positioning table by means of a clamping device, and moving the positioning table parallel to the contact edge for a predetermined distance, the movement of the material on the positioning table being sensed by a second sensor and stopped after the positioning table has moved the predetermined distance.

4. A method according to claim 3, in which said step of moving the material on the positioning table comprises actuating one of the nozzles to cause air to flow therethrough toward the contact edge when one of the first sensors located more remotely from the afore-mentioned nozzle senses that the material is located adjacent to the contact edge, to thereby align the material along the contact edge.

5. A method according to claim 4, in which said step of moving the material on the positioning table further comprises actuating the two nozzles alternately until the material is exactly aligned along the contact edge.

6. A method according to claim 5, further comprising the step of slowing the movement of the positioning table before the material edge on the positioning table is sensed by the second sensor, so that the positioning table can be stopped after exactly the predetermiend distance.

* * * * *